United States Patent [19]

Finkelstein et al.

[11] 4,259,898

[45] Apr. 7, 1981

[54] CEILING AIR OUTLET FOR CLIMATE CONTROL SYSTEM

[75] Inventors: Wolfgang Finkelstein, Neukirchen-Vluyn; Hans Riegel, Geldern; Gerhard Kurzhals, Duisburg, all of Fed. Rep. of Germany

[73] Assignee: Gebrüder Trox, Gesellschaft mit beschrankter Haftung, Neukirchen-Vluyn, Fed. Rep. of Germany

[21] Appl. No.: 80,230

[22] Filed: Oct. 1, 1979

[30] Foreign Application Priority Data

Oct. 2, 1978 [DE] Fed. Rep. of Germany ..... 2842924

[51] Int. Cl.[3] ..... F24F 13/02

[52] U.S. Cl. ..... 98/40 D; 98/40 VM; 98/41 R

[58] Field of Search ..... 98/40 R, 40 B, 40 C, 98/40 D, 40 DL, 40 VM, 41 R

[56] References Cited

U.S. PATENT DOCUMENTS 3,354,808 11/1967 Macrow ..... 98/40 C

FOREIGN PATENT DOCUMENTS 2033194 1/1972 Fed. Rep. of Germany ..... 98/40 D

*Primary Examiner*—Albert J. Makay
*Assistant Examiner*—Harold Joyce
*Attorney, Agent, or Firm*—Shlesinger, Arkwright, Garvey & Dinsmore

[57] ABSTRACT

A ceiling air outlet for a climate control system having a first outflow channel for receiving air and delivering it in a substantially horizontal direction from an outlet surface, a second outflow channel for receiving air and delivering it in a substantially vertically downward direction from the outlet surface, the first and second outflow channels having at their inlet ends a common air supply channel, and a damper mounted in the connecting region of the first and second overflow channels and the supply channel for automatically regulating the air flow into one of the outflow channels in response to the volume flow of air, the damper closing the outflow channel in response to lower volume flow of air and opening the outflow channel in response to higher volume flow of air, whereby the speed of the air delivered from the outlet surface is maintained at an adequate level.

6 Claims, 2 Drawing Figures

CEILING AIR OUTLET FOR CLIMATE CONTROL SYSTEM

Figure 1:
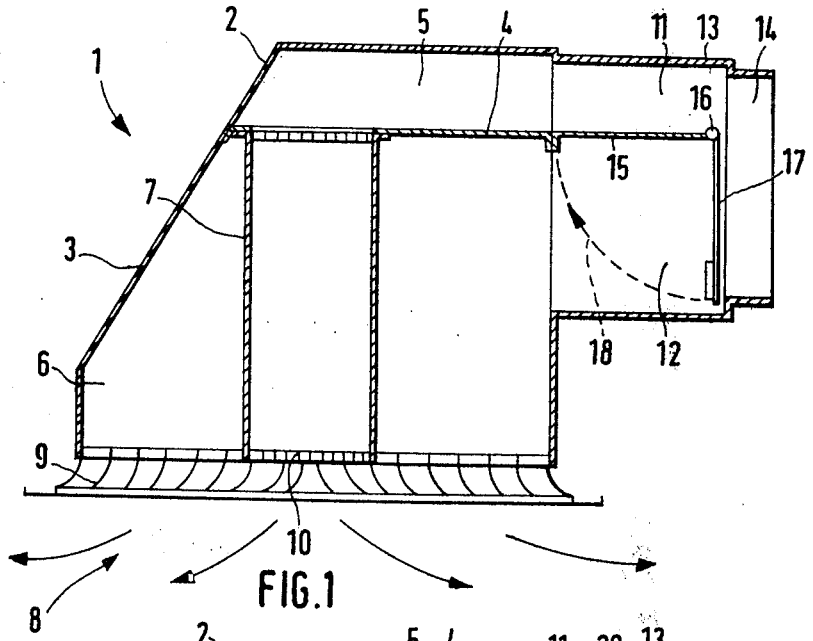

The invention concerns a ceiling air outlet for climate control systems with a housing having two outflow channels, of which one, if necessary or desirable, directs air fed to the housing downward in a basically vertical direction, and the other, which particularly terminates in the edge region of the housing, directs the air in a basically horizontal direction.

Difficult requirements are placed on climate control systems with respect to the guiding of air at the ceiling air outlets. This applies both to cold air supply in summer and warm air supply in winter. In order to achieve uniform air distribution in the space being served, ceiling air outlets are frequently provided with two outflow channels, one of which delivers the supplied air in a basically vertically downward direction, and the other delivers it in a basically horizontal direction. However, satisfactory distribution of the air in the space is only achieved if the air speed does not fall below certain values. If the air speed is too low, it is possible that the air supply will no longer reach certain areas of the space; so-called dead spaces develop. Excessively low air speeds may particularly occur when the air volume delivered by the climate control system varies.

The problem of the invention is thus to maintain adequate exit speed in the face of variations in the air volume supplied.

This problem is solved in a ceiling air outlet of the type initially described, by incorporating the outlet channels in a common air supply channel, and by mounting, in the connecting region, a regulating damper actuated by the air stream, whereby said damper covers one of the outflow channels, when said damper is in the closed position.

The air outlet speed is automatically regulated by the ceiling air outlet according to the invention, because when the air volume supplied is high the regulating damper swings into the open position under the action of the dynamic pressure, so that the air supplied can also flow out through the outlet channel which is closable by the regulating damper. If the air volume supply drops, then the regulating valve more or less closes, automatically, so that far less air exits through the outlet channel which is closable by the regulating damper, while air with the prescribed speed and in the prescribed amount exits through the other outlet channel.

According to a preferred embodiment of the invention the two outlet channels can run in a horizontal direction, one on top of the other, in the region of the connection to the supply channel, wherewith the regulating damper is swingably mounted on a separating wall between the two outlet channels, so that it swings around a horizontal axis. In this embodiment the weight of the regulating damper itself is used to produce the resetting force.

In particular, the regulating damper may extend into the lower outlet channel and have a surface area which basically corresponds to the cross section of that outlet channel. The regulating damper closes to a greater or lesser degree depending on the volume flow at the time, whereby a corresponding air flow passes through the lower outlet channel, while the upper outlet channel remains free continuously, and passes the predetermined volume flow.

In another embodiment the regulating damper may have a section extending into the upper outlet channel, the area of which section basically corresponds to the cross section of the upper outlet channel, and wherein said section is at an angle to the section extending into the lower outlet channel; and said angle represents a bend in the flow direction. The two sections may be oriented at an angle of 90 to 110 degrees from each other. With this embodiment the regulating damper is swung under the action of the dynamic pressure of the air supply stream, whereupon the volume flows in both outlet channels change. In one extreme position of the regulating damper one of the outlet channels, e.g. the lower outlet channel, is closed, and in the other extreme position the other channel is closed, so that in either extreme position only one of the outlet channels passes air.

In combination with the above-described features the relations can be optimized, whereby the two outlet channels may have different cross sections. In particular, the outlet channel which delivers the supplied air vertically downward may have a smaller cross section than the other outlet channel. By appropriate matching of the dimensions of the cross sections of the outlet channels it is possible to achieve the result, in connection with the regulating damper, that even when the air volume supplied by the climate control system is minimal the air will exit from the ceiling outlet with adequate speed. The ceiling air outlet according to the invention is particularly suitable for use in VAL systems.

In the following, example embodiments of the invention which are represented in the drawings are discussed.

Figure 2:
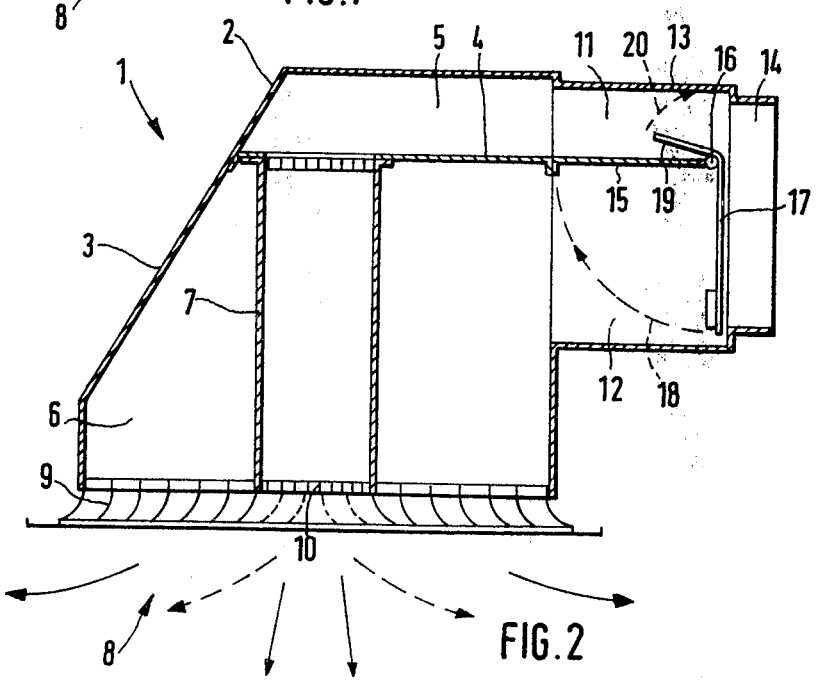

FIG. 1 is a schematic vertical cross sectional view of a ceiling air outlet according to the invention; and FIG. 2 is a different embodiment of the subject of FIG. 1.

Like label numbers in the Figures designate like parts.

The ceiling air outlet 1 shown in the Figures has a housing 2 which is rectangular in horizontal cross section and has sloping side walls 3. The inner space of housing 2 is divided into an upper chamber 5 and a lower chamber 6 by a horizontal separating wall 4 disposed in the upper region of said space. A tube 7 extends from upper chamber 5 and runs vertically downward through the middle of lower chamber 6 to exit side 8. Sheet pieces 9 which bend outward are mounted at the exit side 8 between tube 7 and the side faces 3 of housing 2, while tube 7 has a flow straightener 10 at its outlet opening.

The two chambers 5 and 6 which open out at entrance side 8 and through which the supplied air flows out of the ceiling air outlet are connected by outflow channels 11 and 12 which are formed in a connecting member 13 which is connected to housing 2 on the side of the latter. Connecting member 13 connects to air supply channel 14. Separating wall 15 is located in connecting member 13. In the example embodiment shown, wall 15 is positioned so as to form an extension of separating wall 4 which separates the two chambers 5 and 6; said wall 15 separates the two outflow channels 11 and 12, and supports at its edge directed toward air supply channel 14 a hinge or shaft 16 on which regulating damper 17 is swingably suspended.

In the embodiment of FIG. 1 regulating damper 17 is suspended in lower outflow channel 12 and is subject to the action of its own weight. It has an area which basically corresponds to the cross section of lower outflow channel 12. If the climate control system delivers a relatively large volume of air the regulating damper 17 is swung in the direction of arrow 18, and the supplied air flows both through outflow channel 11 and outflow channel 12. If the air volume delivered by the climate control system drops, regulating damper 17 closes more and more as said volume drop progresses until it reaches the resting position shown in FIG. 1. Apart from leakage, air no longer flows through outflow channel 12; the entire air flow now passes through outflow channel 11, which channel in both example embodiments has a smaller cross section than outflow channel 12. Hereby the supplied air can exit at exit side 8 with adequate speed.

In the embodiment of FIG. 2 the regulating damper 17 has a section 19 which extends into upper outflow channel 11 and is bent at an angle of between 90 and 110 degrees in the flow direction, with respect to the lower section of regulating damper 17. Upper section 19 has an area which corresponds to the cross section of the upper, smaller outflow channel 11. With this embodiment if a sufficient air volume is delivered from the climate control system then damper 17 is swung in the direction of arrow 18, wherewith section 19 is simultaneously swung in the direction of arrow 20. At a high enough air volume, damper 17 is swung so far that upper outflow channel 11 is cut off. At a relatively small air volume the damper 17 swings into the position shown in FIG. 2 and cuts off the lower outflow channel 12, so that the entire air flow passes through outflow channel 11.

In the two example embodiments shown, the outflow channels have their dimensions so chosen that with the damper at the position illustrated about 25% of the normal air volume flows through the upper outflow channel, in each embodiment. Other dimensional relations are possible. If desired, flow straightener 10 in the region of tube 7 may also be replaced by flow-guiding sheets 9, so that the air flowing out from upper outflow channel 11, chamber 5, and tube 7 is not discharged vertically downward but like the air associated with the other channel is discharged horizontally.

We claim:

1. A ceiling air outlet for a climate control system, comprising:

a housing having an outlet surface;

a first outflow channel in said housing for receiving air and delivering it in a substantially horizontal direction from said outlet surface;

a second outflow channel in said housing for receiving air and delivering it in a substantially vertically downward direction from said outlet surface;

said first and second outflow channels having at their inlet ends a common air supply channel; and, damper means mounted in the connecting region of said first and second outflow channels and said supply channel for automatically regulating the air flow into one of said outflow channels in response to the volume flow of air, said damper means closing said one of said outflow channels in response to a lower volume flow of air and opening said one of said outflow channels in response to a higher volume flow of air, whereby the speed of the air delivered from said outlet surface is maintained at an adequate level.

2. The ceiling air outlet of claim 1 wherein said first and second outflow channels are horizontally disposed in the connecting region of said first and second outflow channels and said supply channel with said second outflow channel being positioned above said first outflow channel and with said outflow channels having a separating wall therebetween, said damper means being swingably mounted on a horizontal axis on said separating wall.

3. The ceiling air outlet of claim 2 wherein said damper means is suspended into said first outflow channel from said horizontal axis and has a surface area substantially corresponding to the cross sectional area of said first outflow channel whereby the setting of said damper means is produced by the interaction of gravity tending to close said damper means and the volume flow of air tending to open said damper means.

4. The ceiling air outlet of claim 3 wherein said damper means includes a section extending into said second outflow channel, said section having a surface area substantially corresponding to the cross sectional area of said second outflow channel and being disposed at an angle with respect to the section of said damper means in said first outflow channel and inclined in the direction of flow.

5. The ceiling air outlet of claim 4 wherein said sections of said damper means are disposed at an angle of 90 to 100 degrees with respect to one another.

6. The ceiling air outlet of claim 1 wherein said second outflow channel has a smaller cross sectional area than said first outflow channel.

* * * * *